US006112820A

United States Patent [19]

Job et al.

[11] Patent Number: 6,112,820

[45] Date of Patent: Sep. 5, 2000

[54] SPRAY NOZZLE FOR FIRE EXTINGUISHING DEVICES

[75] Inventors: Eduard J. Job, Ahrensburg; Christian Schnoor, Lübeck, both of Germany

[73] Assignee: Job Lizenz GmbH & Co. KG, Ahrensburg, Germany

[21] Appl. No.: 09/273,628

[22] Filed: Mar. 23, 1999

[30] Foreign Application Priority Data

Apr. 8, 1998 [EP] European Pat. Off. ..... 98106421

[51] Int. Cl.[7] ..... A62C 37/12

[52] U.S. Cl. ..... 169/41; 169/37

[58] Field of Search ..... 169/37, 38, 41, 169/40, 90

[56] References Cited

U.S. PATENT DOCUMENTS

| | | | |
|---|---|---|---|
| 2,375,832 | 6/1945 | Tyden . | |
| 3,812,915 | 5/1974 | Livingston | 169/38 |
| 3,831,682 | 8/1974 | Calcaro | 169/37 |

FOREIGN PATENT DOCUMENTS

| | | |
|---|---|---|
| 2138923 | 1/1973 | France . |
| 2703459 | 8/1977 | Germany . |
| 3530497 | 12/1986 | Germany . |
| 346984 | 4/1931 | United Kingdom . |

*Primary Examiner*—Lesley D. Morris
*Attorney, Agent, or Firm*—Friedrich Kueffner

[57] ABSTRACT

A spray nozzle for fire extinguishing devices with a nozzle body and a valve for a valve body provided at the nozzle opening, wherein the valve body is held in a closed position by a support member which is secured by a thermal release element. The support member is connected to the nozzle body through a hook-type connection and has a unilaterally protruding lever arm. A bearing lever is mounted on the nozzle body so as to be located opposite the protruding lever arm in such a way that the thermal release element is located between the protruding lever arm and the bearing lever laterally next to the nozzle body.

5 Claims, 2 Drawing Sheets

SPRAY NOZZLE FOR FIRE EXTINGUISHING DEVICES

BACKGROUND OF THE INVENTION

1. Field of the Invention

The present invention relates to a spray nozzle for fire extinguishing devices with a nozzle body and a valve for a valve body provided at the nozzle opening, wherein the valve body is held in a closed position by a support member which is secured by a thermal release element.

2. Description of the Related Art

Various spray nozzles and sprinklers for fire extinguishing devices are known in the art. They all have a valve body which is held in the closed position through a support member by means of a thermal release element, preferably a glass bulb. The pressure of a fire extinguishing liquid acts against the valve body. When a safety case occurs, i.e., when the temperature increases to such an extent that the thermal release element is destroyed, it must be ensured that the support member releases the valve body, so that the fire extinguishing liquid can reach the location of the fire.

SUMMARY OF THE INVENTION

Therefore, it is the primary object of the present invention to provide a spray nozzle of the above-described type which is of simple construction and small structural size, and which particularly has a low structural height and can be manufactured inexpensively.

In accordance with the present invention, the support member is connected to the nozzle body through a hook-type connection and has a unilaterally protruding lever arm. A bearing lever is mounted on the nozzle body so as to be located opposite the protruding lever arm in such a way that the thermal release element is located between the protruding lever arm and the bearing lever laterally next to the nozzle body.

Consequently, the spray nozzle according to the present invention includes a support member with a laterally protruding lever arm which forms one bearing for the thermal release element. The other bearing is the bearing lever which is also fastened to the nozzle body but at a distance from the protruding lever arm. The support member with the protruding lever arm is hooked in the manner of a bottle cap opener in the nozzle body in the area of the valve seat in such a way that in the case of fire, i.e., when the thermal release element is destroyed, this connection is reliably separated, so that the valve body can leave the valve seat. The structural height is small because of the fact that the thermal release element is arranged laterally adjacent and essentially parallel to the longitudinal direction of the nozzle body. The support member can be constructed in a simple and inexpensive manner as a bent component.

In accordance with a feature of the present invention, the laterally protruding lever arm is constructed resiliently under initial tension for supporting the thermal release element. As a result of this feature, the thermal release element is held securely and, in addition, a simple assembly of the thermal release element is possible. In order to carry out the assembly, the spring travel distance of the lever arm is utilized for positioning the thermal release element, for example, a glass bulb, in its location.

In accordance with another feature, an incision or recess is formed in the end face of the nozzle body above the valve seat for receiving the lever arm of the support member which supports the valve body. This ensures that the support member receiving the protruding lever arm cannot be displaced laterally. Accordingly, the lever arm is supported by engaging in a positive manner like a hook around the parallel sides of the nozzle head, on the one hand, and by being placed in the recess of the end face of the nozzle body, on the other hand.

In accordance with another feature, the nozzle body is provided with a groove for receiving the bearing lever. As a result, the bearing lever located opposite the protruding lever arm is mounted in a secure and immovable manner, wherein the thermal release element is arranged between the bearing lever and the protruding lever arm.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
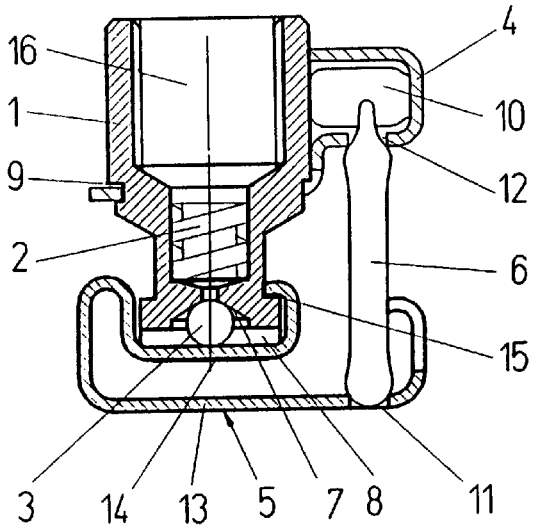
FIG. 1 is a longitudinal sectional view of an embodiment of a spray nozzle according to the invention.
Figure 2:
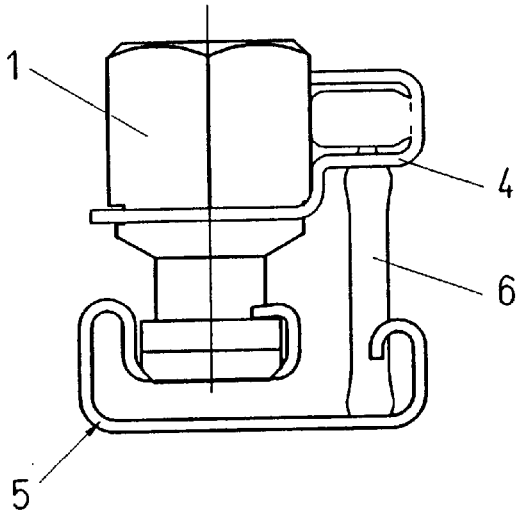
FIG. 2 is a side view of the spray nozzle of FIG. 1 shown in the closed state, i.e., prior to the release of the fire extinguishing process.
Figure 3:
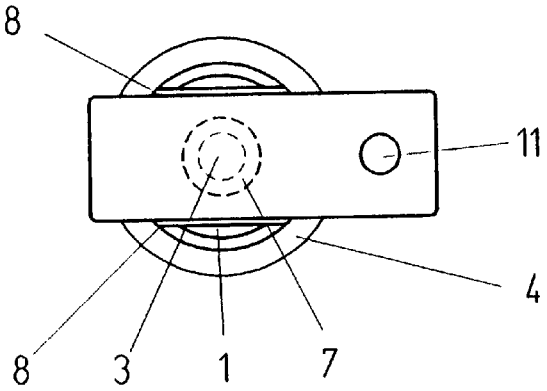
FIG. 3 is a bottom view of the area of the valve seat of the nozzle body.

The spray nozzle illustrated in the drawing is composed of a base body 1 which is mounted in such a way as it is illustrated in the drawing, i.e., with the bore 16 connected to the container for the fire extinguishing liquid being located at the top. A conical and circular valve seat 7 is provided in the lower end face, wherein the valve seat 7 receives a valve body 3 in the form of a ball. Arranged immediately in front of the valve seat as seen in the direction of flow is a twist insert 2.

The valve body 3 is held by a support member 5 which is shaped of spring steel as illustrated in the drawing. The support member 5 has two lever arms 13 and 14. One lever arm 14 is hooked at 15 in the nozzle body. The lever arm 14 holds the valve body 3 on the seat. The other lever arm 13 is resilient relative to the lever arm 14 and protrudes laterally. The lever arm 13 has an opening 11 for receiving the thermal release element 6.

The other end of the thermal release element 6 is located in an opening 12 in a bearing lever 4 which is also a punched component and is fastened in a groove 9 in the base body 1. The bearing lever 4 has two side panels 10 for protecting the tip of the thermal release element 6 which, in the illustrated embodiment, is a glass bulb.

The end face of the base body 1 which is located adjacent the valve seat 7 has a recess 8 which serves to support and guide the lever arm 14 in this plane. The lever arm 14 and, thus, the support member 5 is prevented by this recess 8 from being displaced in a direction perpendicularly of the plane of the drawing. The hook-type connection at 15 prevents a movement of the support member 5 transversely of the plane of the drawing.

Figure 4:
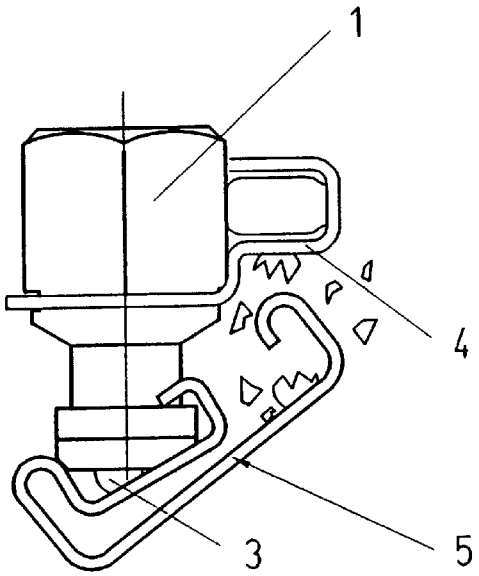
FIG. 4 is a side view of the spray nozzle of FIG. 1, shown immediately after the destruction of the thermal release element.
Figure 5:
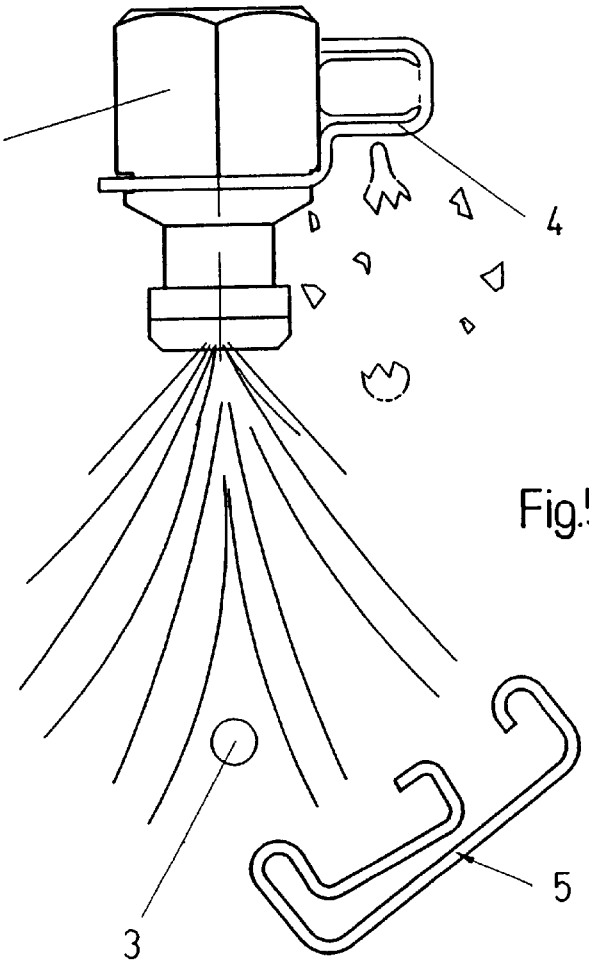
FIG. 5 is a side view corresponding to FIG. 4, however, shown somewhat later when the support member and the valve body have moved completely away from the nozzle body.

In case of fire, i.e., when the thermal release element 6 is destroyed, the support member 5 is moved into the position shown in FIG. 4. This movement is assisted by the spring tension, i.e., the initial tension of the lever arm 13. The support member 5 together with the valve body 3 drop downwardly, as illustrated in FIG. 5. The fire extinguishing liquid can emerge unimpededly. The bearing lever 4 remains in its place at the nozzle body 1 because it is held by being placed in the groove 9.

It is readily apparent that the thermal release element 6 extends with its longitudinal axis essentially parallel to the longitudinal axis of the base body 1, but is located next thereto. This results in a low structural height and the individual structural components are of simple construction and can be manufactured inexpensively. As a result of the lateral or asymmetrical support, together with the spring action of the support member, i.e., the initial tension thereof, it is ensured that those components are safely removed which may no longer be present in the case of a fire.

While specific embodiments of the invention have been shown and described in detail to illustrate the inventive principles, it will be understood that the invention may be embodied otherwise without departing from such principles.

What is claimed is:

1. A spray nozzle for fire extinguishing devices comprising a nozzle body having a nozzle opening, a valve with a valve seat and a valve body received in the valve seat, a support member connected by a hook-type connection to the nozzle body for holding the valve body in a closed position, the support member having a unilaterally protruding lever arm, further comprising a bearing lever connected to the nozzle body such that the bearing lever is located opposite the protruding lever arm, and a thermal release element placed between the bearing lever and the protruding lever arm and next to the nozzle body, wherein the laterally protruding lever arm for supporting the thermal release element is constructed so as to be resilient under initial tension.

2. The spray nozzle according to claim 1, wherein the nozzle body has an end face with a recess above the valve seat for receiving the lever arm of the support member.

3. The spray nozzle according to claim 1, wherein the nozzle body has a groove for receiving the bearing lever.

4. The spray nozzle according to claim 1, wherein the valve body is a ball.

5. The spray nozzle according to claim 1, wherein the valve body is a ball without sealing material and the valve seat is conically shaped with a circular cross-section.

* * * * *